United States Patent [19]

Ess et al.

[11] 4,397,598

[45] Aug. 9, 1983

[54] APPARATUS FOR ALIGNMENT OF LARGE PLANAR MEMBERS AT FEED TABLES OF MACHINE TOOLS

[75] Inventors: Wilfried Ess, Schwarzach; Horst Kollmann, Dornbirn, both of Austria

[73] Assignee: Firma Schelling & Co., Schwarzach, Austria

[21] Appl. No.: 245,708

[22] Filed: Mar. 20, 1981

[30] Foreign Application Priority Data

Mar. 21, 1980 [AT] Austria ..... 1555/80

[51] Int. Cl.[3] ..... B65H 31/34

[52] U.S. Cl. ..... 414/28; 83/467 A; 198/456; 271/221; 271/269; 414/677

[58] Field of Search ..... 414/28, 35, 36, 677; 198/456, 743, 744; 83/278, 467 R, 467 A, 468; 271/221, 222, 233, 269, 271

[56] References Cited

U.S. PATENT DOCUMENTS

| | | | |
|---|---|---|---|
| 584,633 | 6/1897 | Gottlieb | 271/221 |
| 1,563,325 | 12/1925 | Bielaski | 83/438 |
| 3,116,658 | 1/1964 | Baker | 83/278 |
| 3,197,023 | 7/1965 | Achammer | 198/744 |
| 3,501,036 | 3/1970 | Calistrat | 414/55 X |
| 3,980,297 | 9/1976 | Bulso et al. | 271/269 |
| 4,090,703 | 5/1978 | Straube | 271/233 |

*Primary Examiner*—Leslie J. Paperner

*Attorney, Agent, or Firm*—Toren, McGeady and Stanger

[57] ABSTRACT

Apparatus for aligning large planar workpieces on a feed table wherein a plurality of pivoted arms are provided which are biased to a raised pivotal position to engage the edge of a workpiece, with the arms being urged to a lowered pivotal position by the weight of a workpiece resting thereon so that lateral movement of a plurality of the arms which may be arranged in rows will enable one of the arms of a row to engage the edge of a workpiece while in its raised pivotal position thereby to effect positioning or alignment of the workpiece.

15 Claims, 4 Drawing Figures

APPARATUS FOR ALIGNMENT OF LARGE PLANAR MEMBERS AT FEED TABLES OF MACHINE TOOLS

The present invention relates generally to devices for conveying relatively large planar workpieces and, more particularly, to a device usable in conjunction with feed tables of machine tools for aligning such workpieces.

The arrangement of the present invention is particularly useful in moving planar workpieces along a generally horizontal feed table for lateral alignment with a machine tool. The invention relates to devices of the type wherein the edges of the workpieces are engaged so as to slide the workpieces in the horizontal plane of the feed table to desired positions.

Numerous devices of the type for aligning workpieces are known. Usually, these alignment devices may be brought into a position in which they do not hinder the shifting movement of the workpiece on the feed table and the alignment means can either be lifted over the feed table or lowered below the feed table. For each feed table, several alignment means are provided which are connected with each other by means of rods wherein the rods can be activated manually or mechanically in order to move the alignment means in a desired manner. The rods are either rotated or shifted in their axes during this process.

Stops are also provided in machine tools which serve to limit the length or width of the workpiece. In devices known from the prior art, for example, U.S. Pat. No. 1,563,325, several ledges are arranged adjacent each other parallel to the plane of a circular saw blade and the ledges may be swiveled upwardly about an axis provided below the feed table. Each individual ledge is held in its inactive position below the plane of the table by means of control elements engaging at the end face. A locking mechanism is provided for each ledge and when this locking mechanism is released, a plate spring presses the ledge upwardly. Several ledges are combined to a ledge package and in turn a threaded spindle is assigned to each ledge package so that the individual ledge packages can be adjusted at right angles to the plane of the circular saw blade by rotating this threaded spindle. These ledges are not alignment means in the sense of the present invention, but rather width stop means along which the plate shaped workpiece, to be separated by the saw, is guided during sawing.

Other similar prior art arrangements are known from U.S. Pat. Nos. 957,779 and 957,780. Compared with the device of the prior art discussed above, differences exist only insofar as cam-like stops are here provided instead of the elongated ledges. These stop cams have different shapes and are arranged so that they can be swiveled either above or below the feed table or can be lifted and lowered. However, they all have the fact in common that their impact planes lie parallel to the circular saw blade and that they have the task of serving as width stop means during sawing. Alignment in the sense of the invention is not possible with these stops. These stop cams are stationarily arranged with respect to the circular saw blade or the machine table by means of their respective holders.

In the subject matter of U.S. Pat. No. 2,316,971, stops are provided which can be lifted and lowered by means of electromagnetic forces which also serve to limit the length of the workpiece. Here again, alignment in the sense of the present invention is not effected.

Finally, an additional prior art device known from German Offenlegungsschrift 20 08 168 involves width stops at which the workpiece is in contact during the sawing process. These stops can be swiveled upwardly into an inactive position so that a crosscut workpiece may be pushed through below the lifted stops.

It is important to understand that all these stops according to the state of the art are stationarily arranged with respect to the machine table and that the respective workpiece is "stopped" against these stops.

The present invention is directed toward alignment or positioning means of the type described wherein a simplified construction may be provided so that adjusting rods can be omitted and so that the alignment means may be set for a respective workpiece size as automatically as possible.

SUMMARY OF THE INVENTION

Briefly, the present invention may be described as apparatus for positioning workpieces, particularly large planar members, on a feed table comprising base means, a plurality of arms having a first and a second end, means pivotally mounting said first end of each of the arms to the base means, engagement means at the second end of the arms adapted to engage an edge of the planar members to effect a desired positioning thereof, biasing means applying a force urging the arms to a raised pivotal position at which the engagement means are located to engage the edge of a workpiece, said force being of a magnitude to enable each of the arms to be individually pivoted to a lowered pivotal position by the weight of one or more of the workpieces overlying the second end of the arm, with means being provided for moving the arms laterally.

The alignment means of the invention embodied in the pivotal arms are arranged in rows and the pivoted arms are held in their erect, active position by a force which is smaller than that exercised by the weight of a workpiece which rests completely or partially on the alignment means. With the present invention, several of the alignment means or pivoted arms may be aligned in the same direction and arranged on a movable slide so that the swivel axes of the arms may lie below the plane of the feed table. As a result, an adjusting mechanism may be omitted when such alignment means are arranged in rows which are arranged to be movable in their entirety toward the workpiece or away from the workpiece in the plane of the feed table. These alignment means act against an alignment guide against which the workpieces are pressed. When a workpiece is placed on the feed table, then all alignment means which are covered by the workpiece to be aligned are pressed down by the workpiece and only the alignment means located outside the circumferential outline of the workpiece remain in their raised active position and are able to effect an alignment function during the shifting in the plane of the table against the alignment guide. It is also conceivable to hold the alignment means in the lower position during placement of the workpiece and to activate the holding mechanism for the alignment means only after the plates have been placed so that only the free alignment means can move above the contact plane. However, these alignment means which are located below the workpiece are held down by the workpiece.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
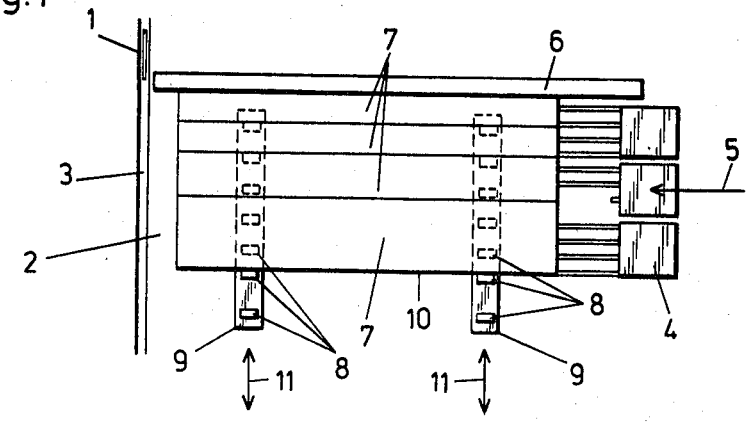
FIG. 1 is a top view of a feed table for a circular saw with which the present invention is utilized.

Referring now to the drawings, the present invention is shown particularly in FIG. 1 operatively associated with a horizontal feed table 2 located directly before a circular saw 1, and depicted in top view. The feed table 2 is formed by a plurality of freely rotatable rollers (not shown). On the side opposite the saw 1, or its cutting plane 3, a feed unit 4 is arranged having a path of movement indicated by the arrow 5. This feed unit operates to move workpieces 7 which lie on the feed table 2 toward the saw 1 or toward its cutting plane 3.

An alignment guide 6 against which the planar workpieces 7 are pressed extends perpendicularly to the cutting plane of the circular saw 1. The workpieces 7 placed on the feed table are pressed against the guides 6 before the feed unit 4 and the saw 1 are placed in operation.

The saw 1 may be constructed in such a way that, when it is put in operation, it will move along the cutting plane 3 above the feed table, the saw then being lowered below the plane of the feed table at the end of the cutting stroke in order to again return to its original position below the plane of the table. Such saws are commonly known in the art.

The alignment means 8 may serve for alignment of the workpieces which may be in strip planar form. Here, the alignment means 8 are provided in two rows wherein the alignment means of one row are supported on a common slide. The slides 9 may be moved to and from the alignment guide 6 in the direction of the arrows 11. The alignment means 8, shown in solid line are in the active position, i.e., they are located to extend above the plane of the feed table and consequently are adapted to come into contact with the edges of the workpieces 7. As indicated in FIG. 1, the portions of the alignment means 8 which are located below the workpieces 7 are shown in dotted lines and the portions which extend from beyond the edge 10 of the workpieces 7 are shown in solid lines.

The alignment means which are located within the circumference to the workpieces 7 and therefore below the workpieces 7 are pressed downwardly by the weight of these workpieces and are consequently brought to an inactive position.

Figure 2:
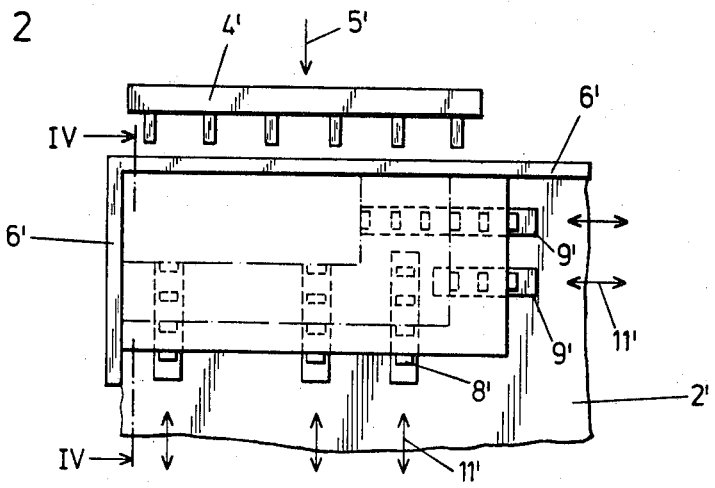
FIG. 2 is a top view of a feed table upon which individual plates, or plates stacked to form packages, are aligned for further processing.

FIG. 2 illustrates in top view a feed table 2′ which may also be constructed from a plurality of freely rotatable rollers or balls. Alignment guides 6′ are here arranged at two adjoining edges. Here again a feed unit 4′ is arranged to be slidable in the direction of the arrow 5′ by means of which the aligned plates or stacks of plates can be pushed to an additional processing station. For each stop guide 6′ several rows of alignment means 8′ are provided which are arranged in rows in a manner already described always on a slide 9′ movable in the direction of the arrow 11′.

FIG. 2 shows different sizes of plates and it is evident from this figure as well as from FIG. 1 that the alignment means 8, 8′ will automatically adjust to the respective size of the workpiece so that for the respective alignment only short paths of movement need be covered by the slide 9, 9′ whose maximum length corresponds to the space between the alignment means in one row. These spaces between the alignment means in one row may be equal or they may also vary.

Figure 3:
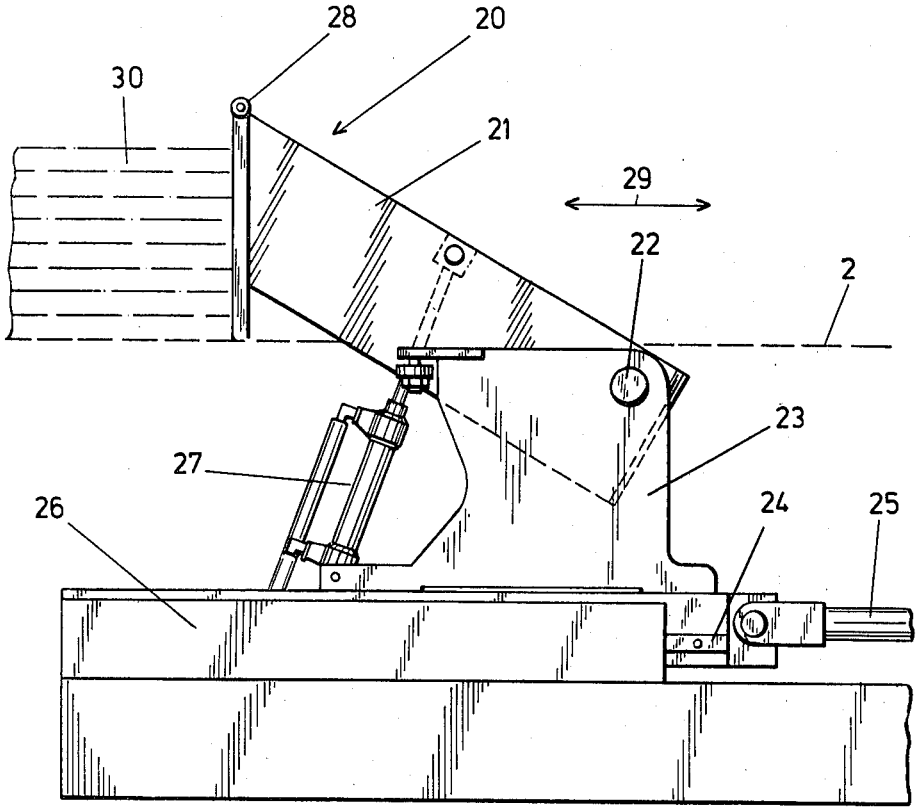
FIG. 3 is a side elevation showing the structural arrangement of a basic element of the present invention.

FIG. 3 shows in greater detail the structural configuration of the basic element of the invention comprising the alignment means 8. As indicated in FIG. 3, an alignment device 20 is shown which includes a lever arm 21 which is pivotally mounted at one end thereof about a swivel axis 22. The alignment device 20 is shown in the active position in FIG. 3 with the lever arm 21 in a raised condition above the plane of the feed table 2.

The lever arm 21 is pivotally mounted upon a base member which comprises a bearing bracket 23 attached upon a slide 24 which is laterally movable in a guide 26 by means of an adjusting element 25. In the active position, the lever 21 is held against the force of its weight by a small pneumatic piston-cylinder unit 27 which acts as a biasing means to bias the lever 21 in the raised position shown in FIG. 3.

At the second or upper end of the lever 21 there is provided a small, freely rotatable roller or cylinder 28 arranged to turn about a horizontal axis of rotation which lies perpendicularly to the direction of adjustment (arrow 29) of the alignment means. A stack of plates comprised of several plates is identified by the reference numeral 30.

The supporting power or holding power of the biasing means of the piston-cylinder unit 27 is so designed as to be small enough that the weight of a workpiece which comes in contact partially or completely on the stop, especially the roller 28, presses the alignment means downwardly and thus transfers it into an inactive position whereupon the lever 21 is pivoted to a lower position beneath a workpiece or plate 30.

Figure 4:
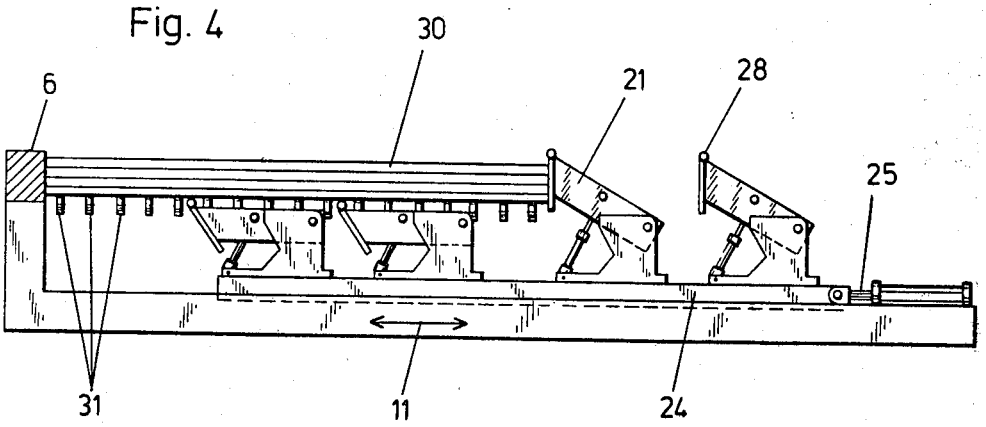
FIG. 4 is a side view of the apparatus of FIG. 2 taken along the line IV—IV.

In the embodiment shown in FIG. 4, the supporting power or holding power for the alignment means is achieved by means of a small pneumatic piston-cylinder unit. Instead of such a piston-cylinder unit, other power elements, for example springs or the like are conceivable. Several alignment means of the type shown in FIG. 3 which form a row on a common slide are arranged in such a way that their swivel axes 22 lie parallel with respect to each other. Also, as seen from FIG. 4, the swivel axes 22 may lie in a common horizontal plane.

Referring now in greater detail to FIG. 4, rollers 31 forming the feed table are arranged with the alignment guide 6 in cooperative arrangement with several of the alignment means of the present invention which are assembled in a row on a slide 24 in a manner which will be evident from FIG. 3. Some of the alignment means are in the active position. That is, the two alignment means shown at the right which are not located below a workpiece 30 are brought to their raised positions by the biasing means 27. These alignment means lie above the circumference of the stack of workpieces 30. The other alignment means which lie below the stack of workpieces 30 are pressed downwardly by the weight of the workpieces. So that the pressed down alignment means located at the underside of the bottom workpiece do not damage the surface of the workpiece during actuation of the adjusting element 25, the freely rotatable rollers or cylinders 28 are provided at the upper side of the alignment means. These rollers can freely roll off at their contact surface without damaging the surface during an adjustment movement in the direction of the arrow 11.

As a result of the present invention, an automatic adjustment to the respective size of the workpiece is possible while completely protecting the surfaces of the workpiece wherein the alignment means must only cover short adjusting distances (arrows 11, 11') during the alignment process so that the work may be performed at high cycle times. The adjustment path of the alignment means, necessary for alignment, is at the maximum equal to the distance between two successive alignment means in one row.

While specific embodiments of the invention have been shown and described in detail to illustrate the application of the inventive principles, it will be understood that the invention may be embodied otherwise without departing from such principles.

What is claimed is:

1. Apparatus for aligning planar workpieces on a feed table relative to a reference position comprising: means defining said reference position; base means; a plurality of arms each located a different distance from said reference position and each having a first and a second end; means pivotally mounting said first end of each of said arms to said base means; engagement means at said second end of each of said arms adapted to engage the edge of a workpiece to urge said workpiece against said means defining said reference position to effect a desired positioning thereof; biasing means applying a force urging said arms to a raised pivotal position at which said engagement means are located to engage an edge of said workpiece, said force of said biasing means being of a magnitude to enable each of said arms to be individually pivoted to a lowered pivotal position beneath a workpiece by the weight of at least one of said workpieces overlying said second end of said arm; and means for moving said arms laterally toward and away from said reference position to effect engagement of said engagement means against the edge of a workpiece depending upon the lateral dimension of said workpiece and upon the position of the arm upon which said engagement means is mounted relative to said reference position.

2. Apparatus according to claim 1 wherein said second ends of said arms are equipped with rollers arranged to engage the underside of a workpiece overlying said second end.

3. Apparatus according to claim 2 wherein said rollers are arranged to rotate about a horizontal axis.

4. Apparatus according to claim 3 wherein said horizontal axis extends perpendicularly to the lateral direction of movement of said arms.

5. Apparatus according to claim 3 wherein said horizontal axis of said rollers extends parallel to the axis about which said arms pivot.

6. Apparatus according to claim 1 wherein said engagement means define a linear surface extending generally perpendicularly to the horizontal when said arms are at said raised pivotal position.

7. Apparatus according to claim 1 wherein said base means comprise a movable slide member having a plurality of said arms pivotally mounted thereto.

8. Apparatus according to claim 1 wherein said arms are arranged in a plurality of separate rows.

9. Apparatus according to claim 8 wherein said plurality of rows extend parallel to each other.

10. Apparatus according to claim 8 wherein said plurality of rows comprise rows extending transversely to each other.

11. Apparatus according to claim 8 wherein said plurality of rows comprise at least two rows extending perpendicularly to each other.

12. Apparatus according to claim 8, 9, 10, or 11 wherein said rows are each laterally movable independently from another row.

13. Apparatus according to claim 1 wherein said biasing means comprise a fluidic piston-cylinder mechanism.

14. Apparatus according to claim 1 wherein said arms are mounted for pivotal movement about generally parallel axes lying in a generally common horizontal plane.

15. Apparatus according to claim 1 wherein said biasing means engage said arms at a point intermediate said first and second ends thereof.

* * * * *